US007673606B2

(12) United States Patent
Ng et al.

(10) Patent No.: US 7,673,606 B2
(45) Date of Patent: Mar. 9, 2010

(54) ROCKER ARM ASSEMBLY

(75) Inventors: Kwok Y. Ng, Rochester Hills, MI (US); Glenn E. Clever, Washington, MI (US); Rodney K. Elnick, Washington, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 428 days.

(21) Appl. No.: 11/765,194

(22) Filed: Jun. 19, 2007

(65) Prior Publication Data

US 2008/0314347 A1 Dec. 25, 2008

(51) Int. Cl.
*F01L 1/18* (2006.01)

(52) U.S. Cl. ..... 123/90.39; 123/90.16; 74/559

(58) Field of Classification Search ..... 123/90.16, 123/90.39; 74/559
See application file for complete search history.

(56) References Cited

U.S. PATENT DOCUMENTS 6,752,107 B2 6/2004 Kreuter
6,814,039 B2 11/2004 Kreuter et al.
6,848,402 B2 2/2005 Kreuter
6,923,151 B2 8/2005 Kreuter
2003/0192497 A1 * 10/2003 Hendriksma et al. ..... 123/90.44

* cited by examiner

*Primary Examiner*—Zelalem Eshete
(74) *Attorney, Agent, or Firm*—Harness, Dickey & Pierce, P.L.C.

(57) ABSTRACT

A two step rocker assembly is provided having a lever body, a first roller assembly mounted to the lever body, and a center shaft extending through the first roller assembly. A second shaft extends through the lever body and defines a first pivot point. A coupling lever is pivotally connected to the second shaft and has an opening for receiving the center shaft. The coupling lever is rotatable about the first pivot point. A latch pin is mounted to the lever body. A second roller assembly is mounted on the center shaft. A spring lever is pivotally connected to the second shaft and is connected to the center shaft. The spring lever is rotatable about the first pivot point. A spring member is mounted on the lever body and engages the spring lever to bias the spring lever and the center shaft into the first position.

19 Claims, 6 Drawing Sheets

ROCKER ARM ASSEMBLY

FIELD

The present disclosure relates to rocker arm assemblies, and more particularly to a two step rocker arm assembly.

BACKGROUND

The statements in this section merely provide background information related to the present disclosure and may or may not constitute prior art.

Internal combustion engines include an arrangement of pistons and cylinders located within an engine block. Each cylinder has at least two valves. These valves control the flow of air to the combustion cylinders and allow for venting of combustion exhaust gasses. A valve train is used to selectively open and close these valves. In some valve trains, it is desirable to control the degree that the valves are opened or closed (i.e., the amount the valve travels). In order to selectively control the valve lift, a 2-step rocker arm assembly is connected to the valve and actuated by a camshaft.

A typical 2-step rocker arm assembly includes an inner and an outer rocker arm actuated by the camshaft. The camshaft typically includes a low-lift cam and a high-lift cam. The camshaft engages the inner and outer rollers of the rocker arm assembly which in turn selectively positions the connected valve between a low-lift mode and a high-lift mode. The low-lift mode causes the valve to travel a first distance and the high-lift mode causes the valve to travel a second distance that is greater than the first distance. While useful for its intended purpose, there is room in the art for an improved rocker arm assembly having improved features to aid in manufacturability.

SUMMARY

The present invention provides a two step rocker arm assembly for use in a valve train having a lever body, a first roller assembly mounted to the lever body, and a center shaft extending through the first roller assembly and moveable with respect to the lever body between a first position and a second position. A second shaft extends through the lever body and defines a first pivot point. A coupling lever is pivotally connected to the second shaft and has an opening for receiving the center shaft therethrough. The coupling lever is rotatable about the first pivot point. A latch pin is mounted to the lever body and is moveable between an extended position and a retracted position. The latch pin is positioned to prevent the coupling lever from pivoting when the latch pin is in the extended position. A second roller assembly is mounted on the center shaft. A spring lever is pivotally connected to the second shaft and is also connected to the center shaft. The spring lever is rotatable about the first pivot point. A spring member is mounted on the lever body and engages the spring lever to bias the spring lever and the center shaft into the first position.

In one aspect of the present invention the lever body includes a pair of parallel arms that define a center opening for receiving the first roller assembly therein.

In another aspect of the present invention the lever body includes a spring retainer portion located on each arm for retaining the spring member.

In yet another aspect of the present invention the spring member includes a connecting portion that extends between a first coiled portion and a second coiled portion, the connecting portion retained by the spring retainer portions on the lever body.

In yet another aspect of the present invention the rocker arm assembly further includes a third roller assembly mounted on the center shaft.

In yet another aspect of the present invention the rocker arm assembly further includes a second spring lever pivotally connected to the second shaft and connected to the center shaft, the second spring lever rotatable about the first pivot point.

In yet another aspect of the present invention the second roller assembly is located on the center shaft between the coupling lever and the first spring lever, and the third roller assembly is located on the center shaft between the lever body and the second spring lever.

In yet another aspect of the present invention the spring lever includes a spring rest pad that extends vertically with respect to the lever body for retaining an end of the spring member.

In yet another aspect of the present invention the spring lever is symmetrical along a horizontal axis relative to the lever body.

In yet another aspect of the present invention the latch pin is located at an end of the lever body opposite the first pivot point.

In yet another aspect of the present invention the latch pin has a cylindrical outer surface and a flat end.

In yet another aspect of the present invention the coupling lever includes a first opening for receiving the second shaft.

In yet another aspect of the present invention the coupling lever includes a second opening for receiving the center shaft.

The present invention further provides a two step rocker arm assembly having a lever body having a pair of arms that each include a spring retainer portion. A first roller assembly is mounted to the lever body. A center shaft extends through the first roller assembly and is moveable with respect to the lever body between a first position and a second position. A coupling lever is pivotally mounted to the lever body and has an opening for receiving the center shaft therethrough. The coupling lever is rotatable about a first pivot point. A latch pin is mounted to the lever body and is moveable between an extended position and a retracted position, the latch pin positioned to prevent the coupling lever from pivoting when the latch pin is in the extended position. A second roller assembly is mounted on the center shaft. A pair of spring levers are pivotally mounted to the lever body and connected to the center shaft. The spring levers have a spring rest pad and are rotatable about the first pivot point. A spring member has a connecting portion that extends between a first end and a second end, wherein the connecting portion is retained by the spring retainer portions on the lever body, the first end is retained by the spring rest pad of one of the spring levers and the second end is retained by the spring rest pad of the other spring lever.

In one aspect of the present invention a side of the lever body is flat.

In another aspect of the present invention the spring retainer portion is "L"-shaped.

In yet another aspect of the present invention the spring member includes a first coiled portion between the connecting portion and the first end and a second coiled portion between the connecting portion and the second end.

The present invention also provides a rocker arm assembly for use in a valve train having a lever body, a center shaft extending through the lever body and moveable with respect to the lever body between a first position and a second position, and a coupling lever having an opening for receiving the center shaft therethrough and having an extending lever arm. The coupling lever is pivotally mounted to the lever body at an end of the extending lever arm and is rotatable about a first pivot point. A spring lever is pivotally mounted to the lever body and is connected to the center shaft. The spring lever is rotatable about the first pivot point. A spring member is mounted on the lever body that engages the spring lever to bias the spring lever and the center shaft into the first position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
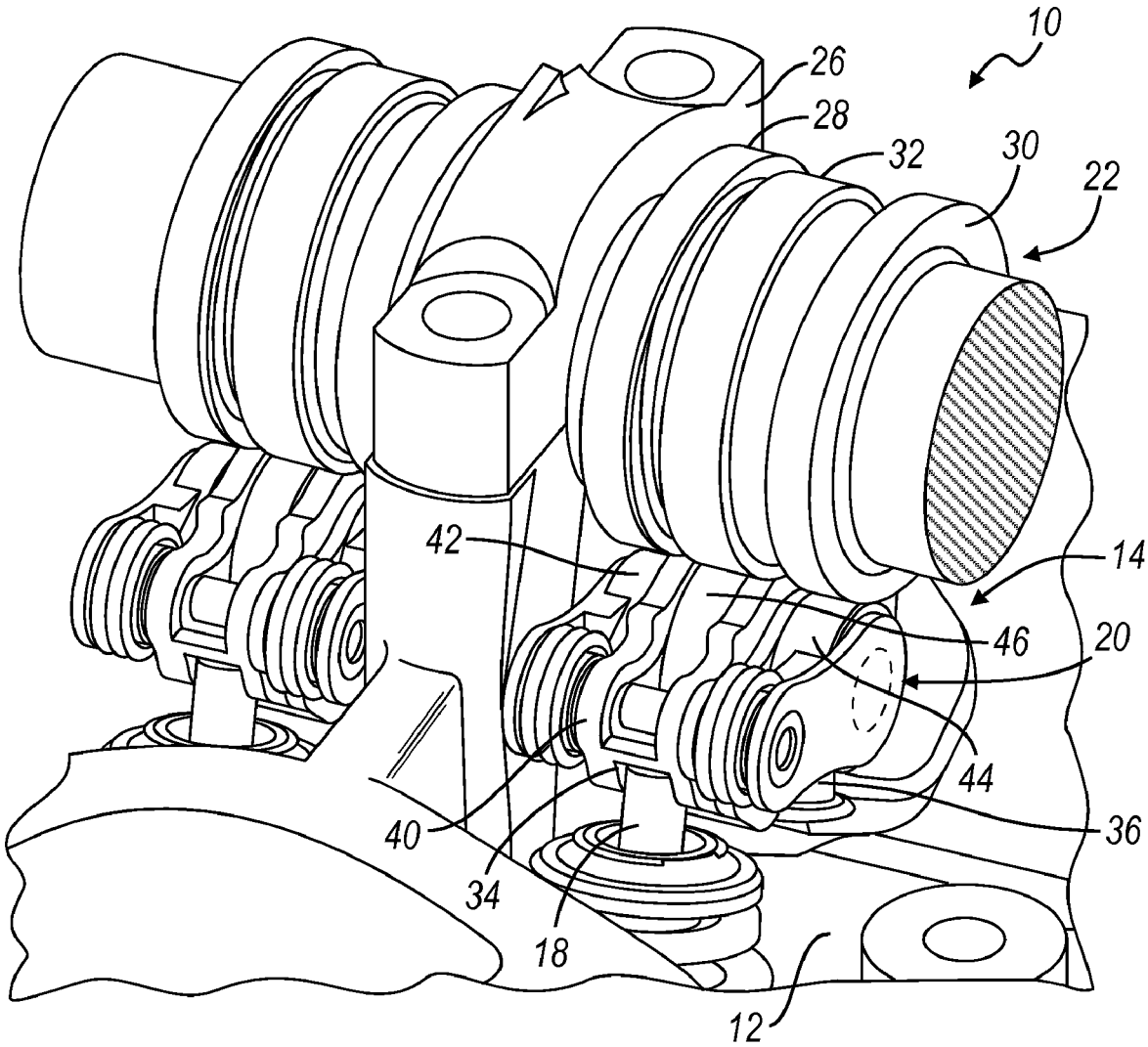
FIG. 1 is an isometric view of an exemplary rocker arm assembly according to the principles of the present invention shown in an exemplary valve train.

With reference to FIG. 1, a portion of an exemplary internal combustion engine is indicated by reference number 10. The engine 10 generally includes a cylinder head 12 that caps a plurality of cylinders (not shown) within the engine 10. A valve train 14 is mounted to the cylinder head 12. The valve train 14 generally includes a valve 18, a rocker arm assembly 20, and a camshaft 22. The valve 18 extends through the cylinder head 12 and into one of the cylinders (not shown) of the engine 10. The valve 18 is operable to selectively open and close to allow intake air to enter the cylinder (in the case of an intake valve) or to allow exhaust to exit the cylinder (in the case of an exhaust valve). The valve 18 is biased into the closed position by a valve spring 24.

The camshaft 22 is mounted to the cylinder head 12 by a cam cap 26. The camshaft 22 includes a first high-lift cam 28, a second high-lift cam 30, and a low-lift cam 32 located between the first and second high-lift cams 28 and 30. The rocker arm assembly 20 is located beneath the camshaft 22 and is coupled to the valve 18 at one end by a valve pad 34 and coupled to the cylinder head 12 at an opposite end by a lash adjuster 36. As will be described in greater detail below, the camshaft 22 is operable to engage the rocker arm assembly 20 to selectively open and close the valve 18.

Figure 2:
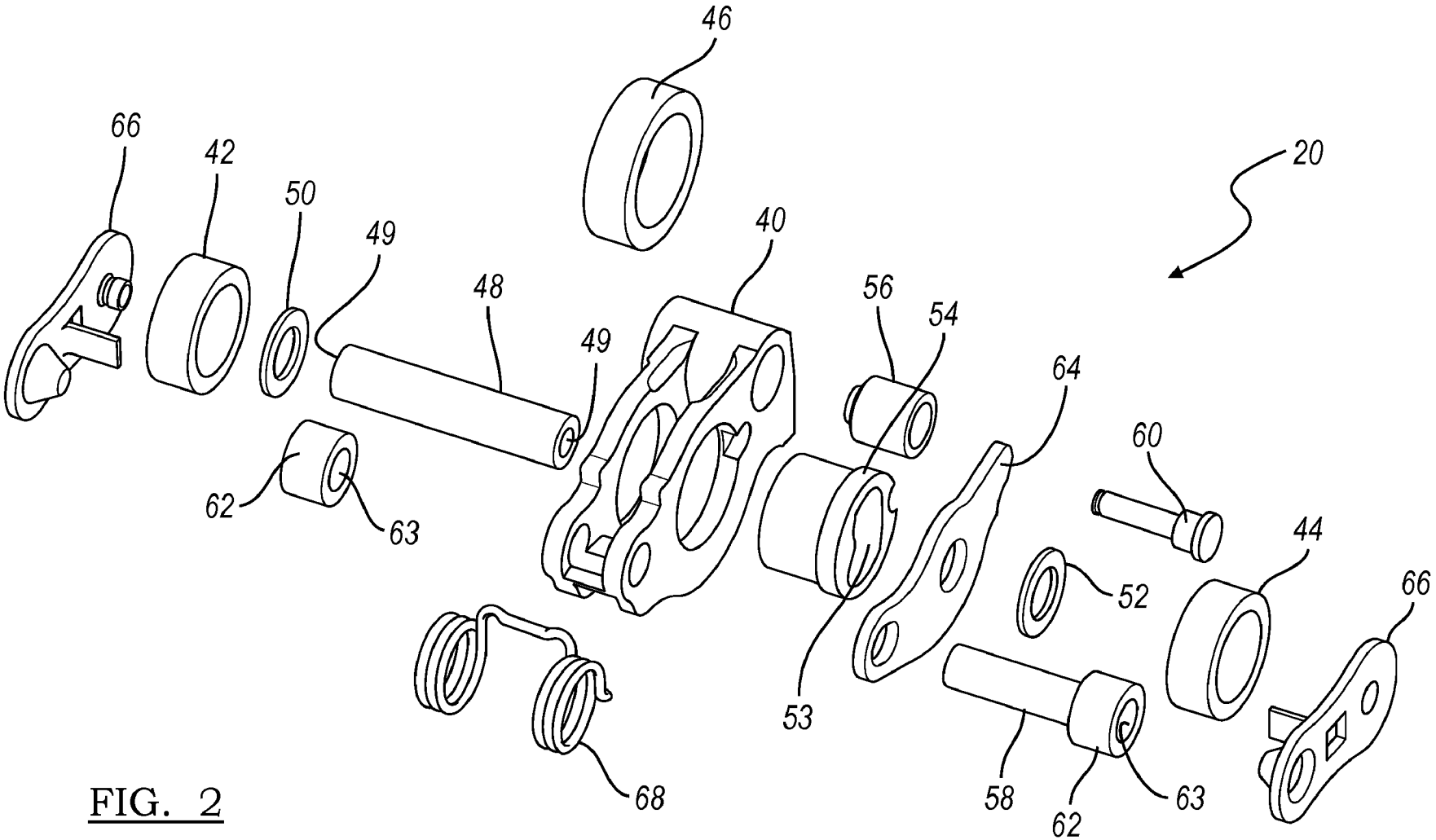
FIG. 2 is an expanded isometric view of the exemplary rocker arm assembly of the present invention.

Turning to FIG. 2, the rocker arm assembly 20 will now be generally described, followed by a more detailed description of specific components. The rocker arm assembly 20 is known as having two steps or modes of operation that allow selective opening of the valve 18, as will be described in greater detail below. The rocker arm assembly 20 generally includes a lever body 40 that supports a first roller assembly 42, a second roller assembly 44, and a third roller assembly 46. The roller assemblies 42, 44, and 46 are preferably bearings having inner and outer rollers, but it should be appreciated that various other kinds of roller assemblies may be employed without departing from the scope of the present invention. The first and second roller assemblies 42 and 44 are supported on a center shaft 48 that extends through the lever body 40. The center shaft 48 is generally cylindrical and includes open ends 49. A first washer 50 is mounted on the center shaft 48 and is located between the first roller assembly 42 and the lever body 40. A second washer 52 is also mounted on the center shaft 48 and is located between the second roller assembly 44 and the lever body 40.

The center shaft 48 is supported within an opening 53 formed in a center bearing 54. The center bearing 54 is generally cylindrical and is supported by the third roller assembly 46 which is in turn supported by the lever body 40. The third roller assembly 46 is positioned such that it is located between the first and second roller assemblies 42 and 44.

The rocker arm assembly 20 further includes a latch pin 56 and a distance sleeve 58. The latch pin 56 is coupled at one end of the lever body 40 by a latch retainer 60. The latch pin 56 is hydraulically actuatable by the lash adjuster 36 and is moveable between a retracted position and an extended position, as will be described in greater detail below. The distance sleeve 60 extends through an opposite end of the lever body 40. The distance sleeve 60 is capped at both ends by distance sleeve caps 62. The distance sleeve caps 62 each define openings 63 at ends thereof.

A coupling lever 64 is supported at one end by the distance sleeve 60 and through the center by the center shaft 48. A pair of spring levers 66 are likewise supported by the distance sleeve 60 and by the center shaft 48. The spring levers 66 form the opposite sides of the rocker arm assembly 20. A spring member 68 is supported by the lever body 40 and engages the pair of spring levers 60.

Figure 3A:
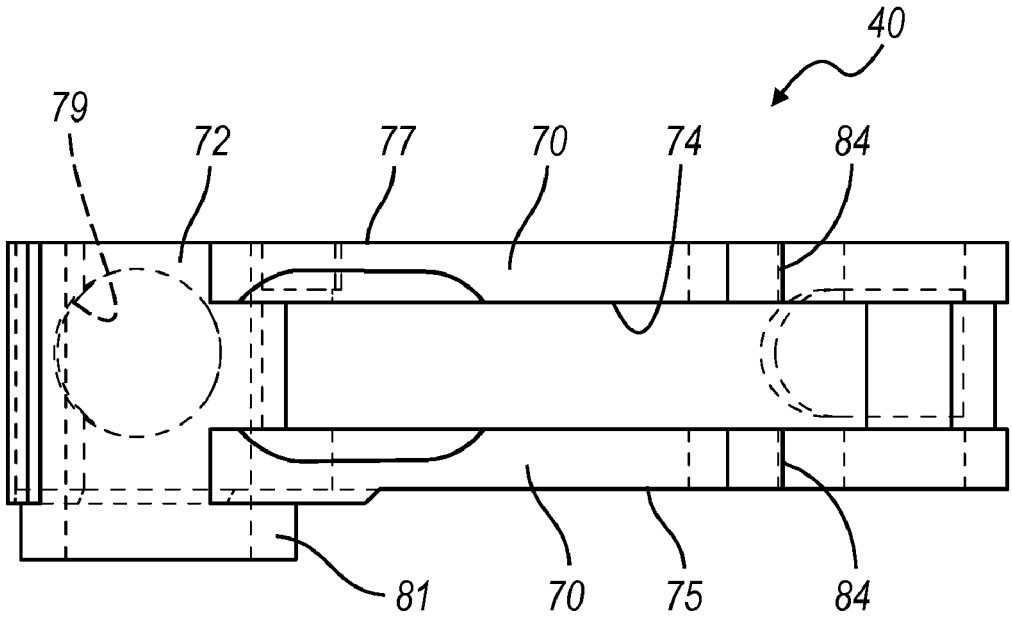
FIG. 3A is an enlarged top view of a lever body used in the rocker arm assembly the present invention.
Figure 3B:
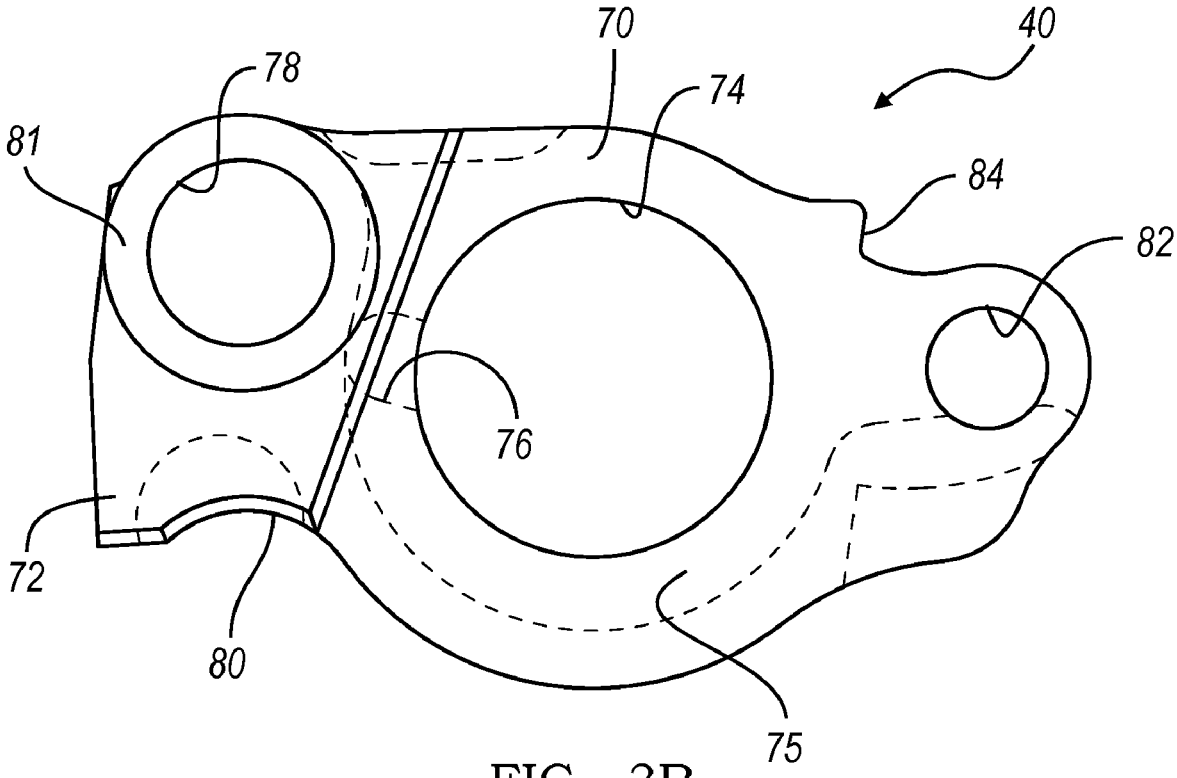
FIG. 3B is an enlarged side view of the lever body used in the rocker arm assembly the present invention.

With reference to FIGS. 3A and 3B, the lever body 40 will now be described in further detail. The lever body 40 includes a pair of parallel, spaced-apart arms 70 that extend out from a body 72. The arms 70 cooperate with the body 72 to define a center opening 74 that extends through the lever body 40 from a first side 75 to a second side 77. The center opening 74 is sized to receive the third roller assembly 46 and the center bearing 54 therein. The center opening 74 includes a key cutout 76 formed in one of the pair of arms 70. The key cutout 76 is sized to receive a key (not shown) coupled to the center bearing 54 in order to orient the center bearing 54 with respect to the lever body 40 and to prevent the center bearing 54 from rotating.

A first opening 78 is formed through the lever body 40 extending from the first side 75 to the second side 77. The first opening 78 is generally cylindrical in shape and is sized to receive the latch pin 56 and latch retainer 60 therein. A slot 79 is formed within the first opening 78 that extends through the body 72 to a bottom side 80 of the lever body 40. The slot 79 allows the lash adjuster to connect with the latch pin 56 in order to hydraulically actuate the latch pin 56. An annular or tubular projection 81 surrounds the first opening 78 on the first side 75 of the lever body 40.

A second opening 82 is formed through the arms 70 from the first side 75 to the second side 77 of the lever body 40. The second opening 82 is positioned such that the center opening 74 is located between the first opening 78 and the second opening 82. The second opening 82 is sized to receive the distance sleeve 58 therethrough. The distance sleeve caps 62 abut the first and second sides 75, 77 of the lever body 40 (as best seen in FIG. 2) such that the distance sleeve 58 is restricted from moving out of the second opening 82.

The arms 70 each define an "L"-shaped spring retainer portion 84 on a top surface 86 of the lever body 40. As will be described in greater detail below, the spring retainer portion 84 acts to support and hold the spring member 68.

Figure 4A:
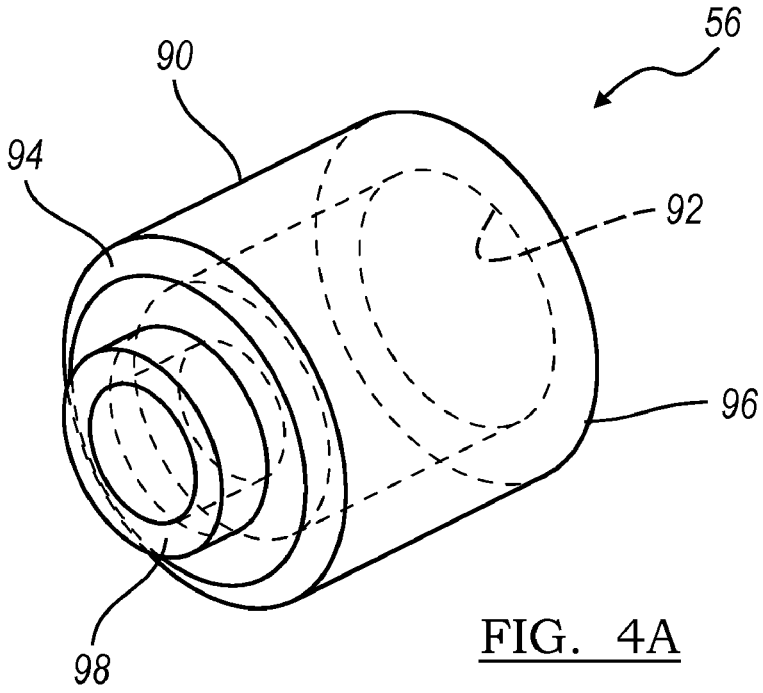
FIG. 4A is an enlarged isometric view of a latch pin used in the rocker arm assembly the present invention.
Figure 4B:
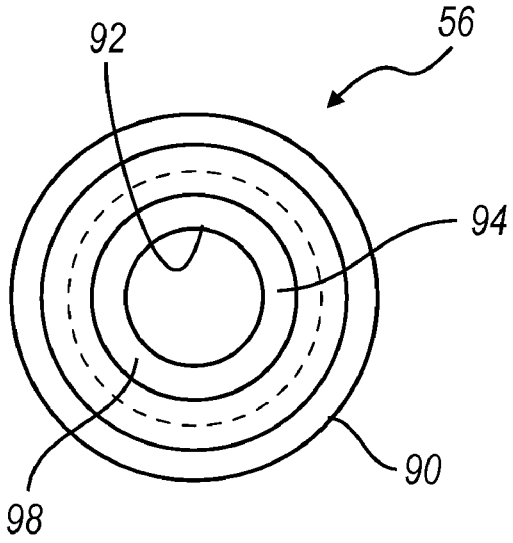
FIG. 4B is an enlarged end view of the latch pin used in the rocker arm assembly the present invention.
Figure 4C:
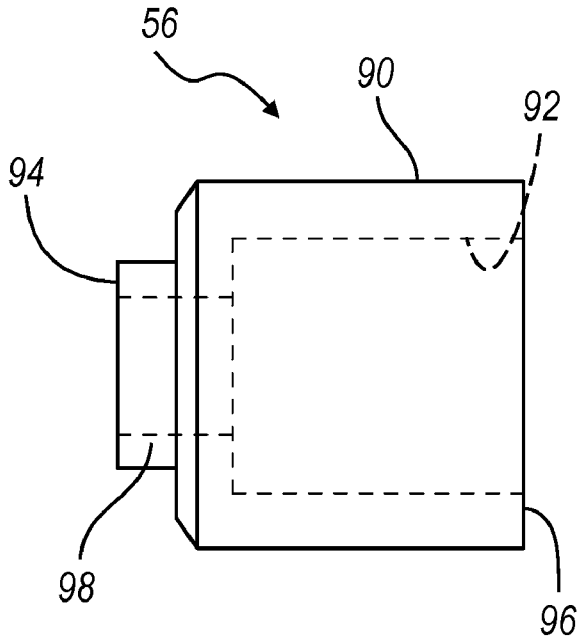
FIG. 4C is an enlarged side view of the latch pin used in the rocker arm assembly the present invention.

With reference to FIGS. 4A-B, the latch pin 56 generally includes a cylindrical body 90. The cylindrical body 90 defines a center hole 92 that extends from a first end 94 to a second end 96. The first end 94 includes a concentric annulus or ring 98 that extends around the center hole 92. The second end 96 is flat in order to simplify the manufacturability of the latch pin 56. As noted above, the latch pin 56 is hydraulically actuatable by the lash adjuster 36 and is moveable between a retracted position and an extended position. The latch pin 56 forms part of a latch assembly that may further include a spring (not shown) operable to bias the latch pin 56 into the retracted position.

Figure 5A:
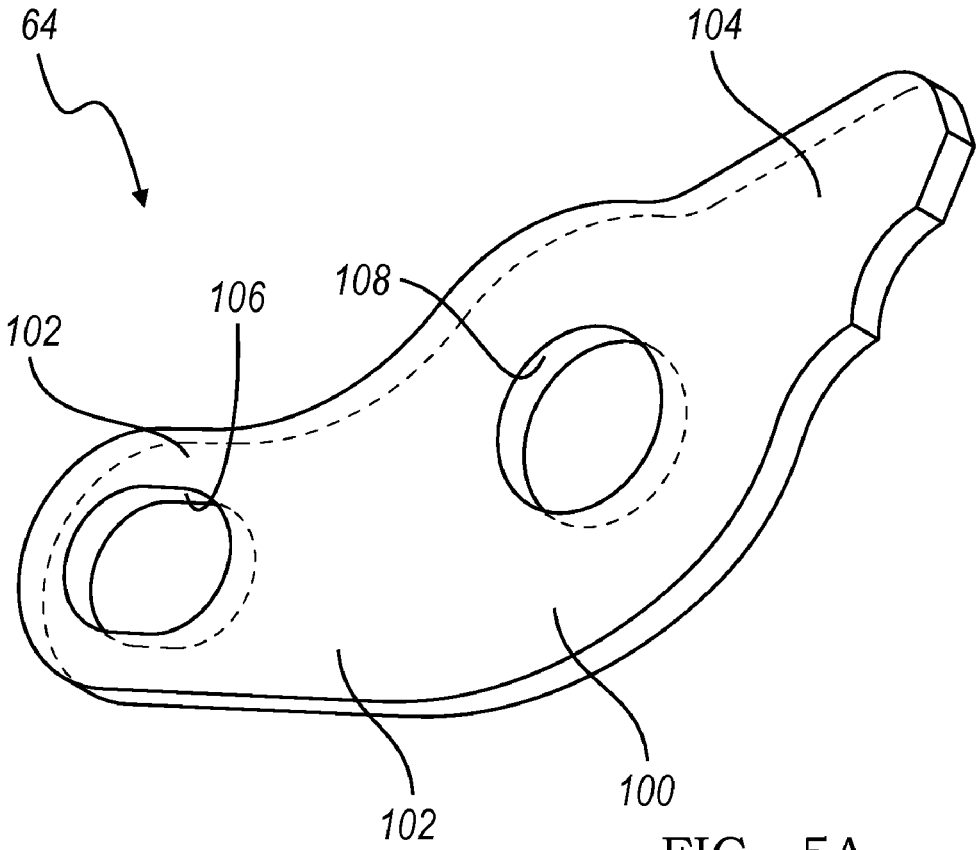
FIG. 5A is an enlarged isometric view of a coupling lever used in the rocker arm assembly the present invention.
Figure 5B:
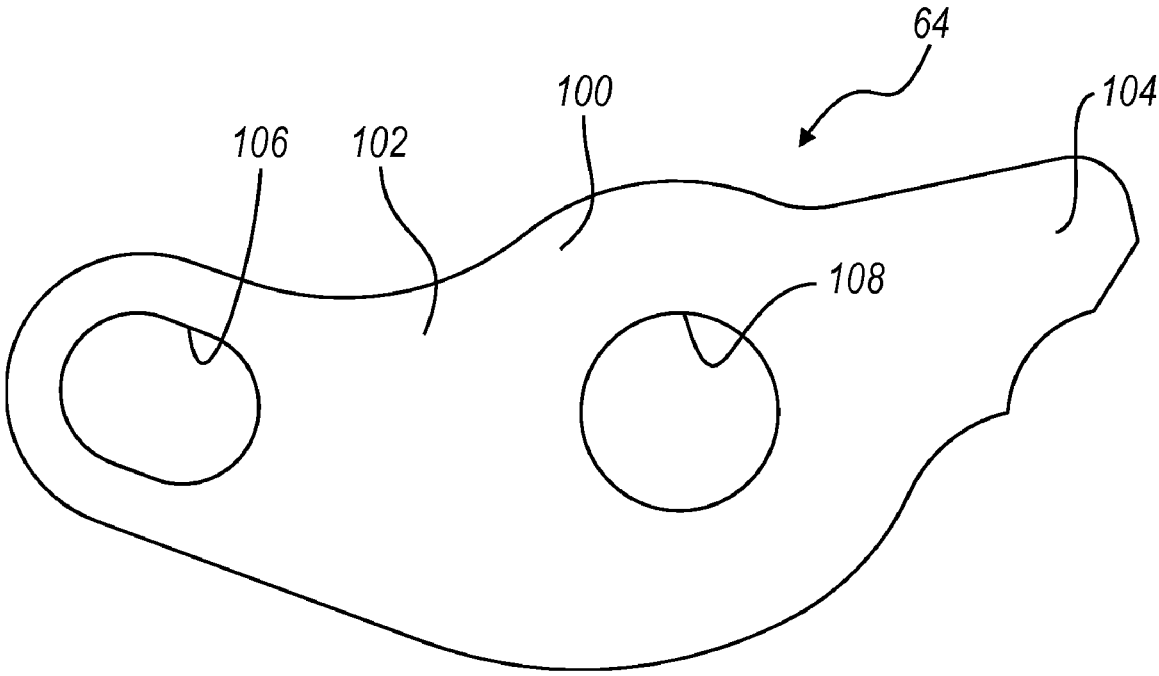
FIG. 5B is an enlarged side view of the coupling lever used in the rocker arm assembly the present invention.

With reference to FIGS. 5A and 5B, the coupling lever 64 will now be described in detail. The coupling lever 64 includes a generally planar body 100 including a lever arm 102 extending in a first direction and a lock tab 104 extending from the body 100 in an opposite direction. The lock tab 104 is operable to abut the latch pin 56 when the latch pin 56 is in the extended position, as will be described in greater detail below.

A first hole 106 is formed through the coupling lever 64 at an end of the lever arm 102. The first hole 106 is receives the distance sleeve 58 therethrough. The first hole 106 has an enlarged shape such that the distance sleeve 58 is able to slightly move freely therein relative to the coupling lever 64. The coupling lever 64 is positioned flush against the second side 77 of the lever body 40 (FIG. 3A). The first hole 106 defines a pivot axis for the coupling lever 64 to pivot about the distance sleeve 58.

A second hole 108 is formed through the body 100 of the coupling lever 64. The second hole 108 is sized to receive the center shaft 48 therethrough. The coupling lever 64 is positioned such that it is between the lever body 40 and the washer 52 and second bearing 44 (FIG. 2). In the preferred embodiment, the coupling lever 64 is a stamped steel piece with spot machining. However, it should be appreciated that various other kinds of methods may be employed to create the coupling lever 64 without departing from the scope of the present invention.

Figure 6A:
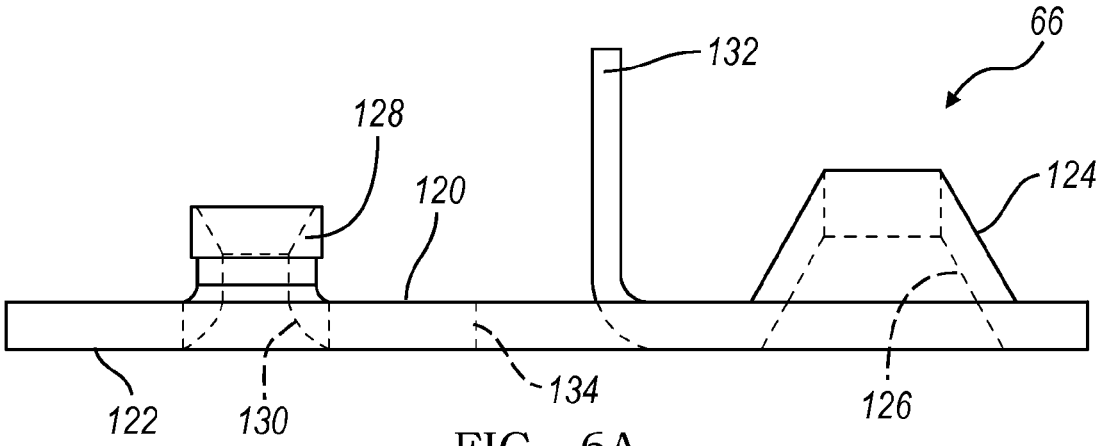
FIG. 6A is an enlarged top view of a spring lever used in the rocker arm assembly the present invention.
Figure 6B:
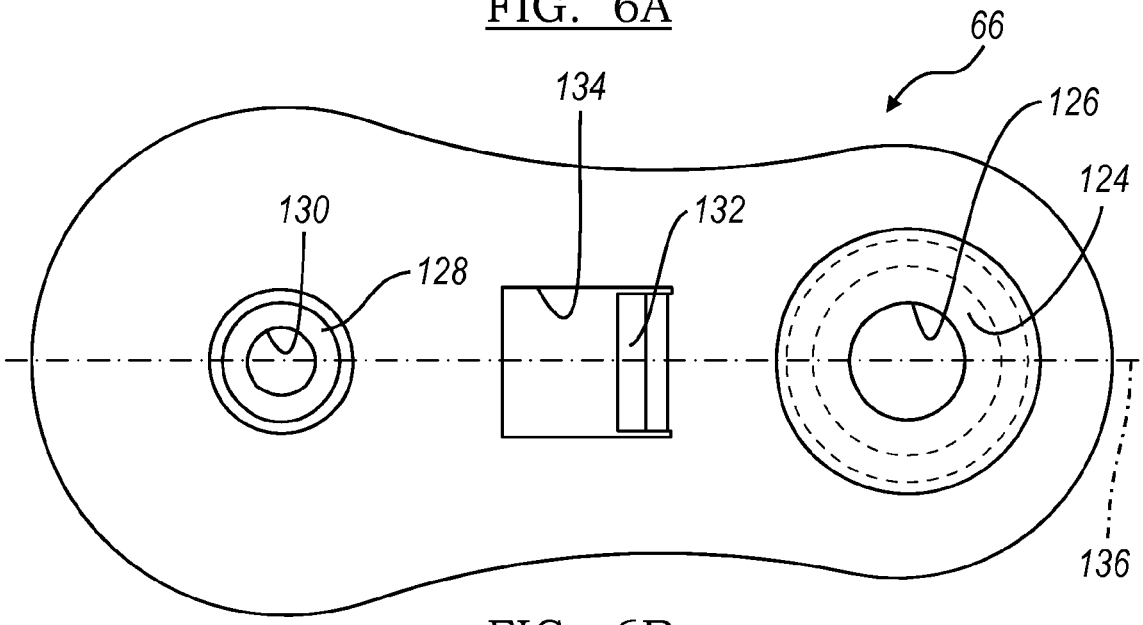
FIG. 6B is an enlarged side view of a spring lever used in the rocker arm assembly the present invention.

Turning to FIGS. 6A and 6B, the spring lever 66 will now be described in greater detail. While two spring levers 66 are employed with the rocker arm assembly 20, only one will be described as the spring levers 66 are identical. The spring lever 66 includes an inner face 120 and an outer face 122. As can be seen in FIGS. 1 and 2, the inner face 120 is configured to abut the lever body 40. The spring lever 66 includes a frusto-conical mounting portion 124 that extends out from the inner face 120 at an end thereof. The mounting portion 124 defines a hole 126 that extends through the spring lever 66 from the inner face 120 to the outer face 122. The mounting portion 124 is sized to fit within the opening 63 of the distance sleeve caps 62 (FIG. 2) and is secured thereto by a fastener (not shown). The spring lever 66 is rotatable about the distance sleeve 58 and accordingly shares the same pivot point as the coupling lever 64.

A tab 128 extends out from the inner face 120 at an end opposite the mounting portion 124. The tab 128 defines a hole 130 that extends through the spring lever 66 from the inner face 120 to the outer face 122. The tab 128 is sized to fit within the opening 49 of the center shaft 48 (FIG. 2) and is secured thereto by a fastener (not shown).

A spring rest pad 132 extends out from the inner face 120. The spring rest pad 132 has a generally planar shape and is oriented such that the planar surfaces of the spring rest pad 132 are vertical with respect to the lever body 40. An opening 134 extends through the spring lever 66 from the inner face 120 to the outer face 122 at the base of the spring rest pad 132. The spring rest pad 132 is configured to engage a portion of the spring mechanism 68.

As shown in FIG. 6B, the spring lever 66 is symmetrical about an axis indicated by reference number 136 that is substantially horizontal with respect to the lever body 40. This symmetry and orientation allows a single spring lever 66 design to accommodate both sides of the rocker arm assembly 20. Preferably, the spring lever 66 is a stamped steel piece, though it should be appreciated that various other methods of manufacturing the spring lever 66 may be employed without departing from the scope of the present invention.

Figure 7:
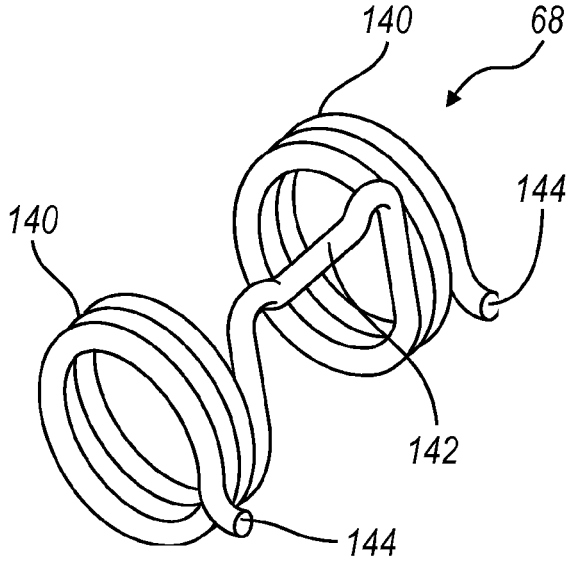
FIG. 7 is an enlarged isometric view of a spring member used in the rocker arm assembly the present invention.

With reference to FIG. 7, the spring member 68 generally includes a pair of coiled portions 140 connected by an intermediate portion 142 that extends between the coiled portions 140. The intermediate portion 142 is configured to rest on the spring retainer portions 84 of the lever body 40 (FIG. 3A, B). The spring member 68 includes a pair of ends 144 that extend out from a respective one of the coiled portions 140. The ends 144 engage the spring rest pads 132 on the spring lever 66 (FIG. 6A, B).

With combined reference to FIGS. 1-7, the general operation of the rocker arm assembly 20 will now be described. As can best be seen in FIG. 1, the roller assemblies 42, 44, and 46 are positioned such that they are engageable by the camshaft 22. More specifically, the first roller assembly 42 is selectively actuated by the first high-lift cam 28 of the camshaft 22, the second roller assembly 44 is selectively actuated by the second high-lift cam 30, and the third roller assembly 46 is selectively actuated by the low-lift cam 32.

During the first high-lift mode of operation, the latch pin 56 is extended and therefore the coupling lever 64 is locked from rotation about its pivot point (the opening 106). The coupling lever 64 in turn locks the center shaft 48 from moving within the opening 53 of the center bearing 54. The high-lift cams 28 and 30 engage and push downward the first and second roller assemblies 42 and 44 which are locked from rotation relative to the lever body 40. Accordingly, the lever body 40 actuates to open the valve 18 to a first opened position.

During the low-lift mode of operation, the latch pin 56 is retracted and the coupling lever 64 is unlocked and free to rotate about its pivot point (the opening 106). The center shaft 48 is accordingly free to move within the opening 53 of the center bearing 54. As the high-lift cams 28 and 30 engage the first and second roller assemblies 42 and 44, the center shaft 48 is free to move within the center bearing 54, and the center shaft 48, roller assemblies 42 and 44, and spring levers 66 move downward relative to the lever body 40. Therefore, the force from the high-lift cams 28 and 30 is not transferred into opening the valve 18. However, the low-lift cam 32 engages the center bearing 54 which is fixed relative to the lever body 40 and accordingly the lever body actuates the valve to a second opened position that is less than the first opened position. As the cams 28, 30, 32 move out of engagement with the roller assemblies 42, 44, 46, the spring mechanism 68 biases the spring lever arms 66 back to a rest position, and the valve 18 is closed.

The description of the invention is merely exemplary in nature and variations that do not depart from the gist of the invention are intended to be within the scope of the invention. Such variations are not to be regarded as a departure from the spirit and scope of the invention.

What is claimed is:

1. A rocker arm assembly for use in a valve train comprising:

a lever body;

a first roller assembly mounted to the lever body;

a center shaft extending through the first roller assembly and moveable with respect to the lever body between a first position and a second position;

a second shaft extending through the lever body and defining a first pivot point;

a coupling lever pivotally connected to the second shaft and having an opening for receiving the center shaft, the coupling lever rotatable about the first pivot point;

a latch pin mounted to the lever body and moveable between a retracted position and an extended position which inhibits pivoting of the coupling lever;

a second roller assembly mounted on the center shaft;

a spring lever pivotally connected to the second shaft and connected to the center shaft, the spring lever rotatable about the first pivot point; and a spring member mounted on the lever body that engages the spring lever to bias the spring lever and the center shaft into the first position.

2. The rocker arm assembly of claim 1 wherein the lever body includes a pair of parallel arms that define a center opening for receiving the first roller assembly therein.

3. The rocker arm assembly of claim 2 wherein the lever body includes a spring retainer portion located on each arm for retaining the spring member.

4. The rocker arm assembly of claim 3 wherein the spring member includes a connecting portion that extends between a first coiled portion and a second coiled portion, the connecting portion retained by the spring retainer portions on the lever body.

5. The rocker arm assembly of claim 4 further comprising a third roller assembly mounted on the center shaft.

6. The rocker arm assembly of claim 5 further comprising a second spring lever pivotally connected to the second shaft and connected to the center shaft, the second spring lever rotatable about the first pivot point.

7. The rocker arm assembly of claim 6 wherein the second roller assembly is located on the center shaft between the coupling lever and the first spring lever, and the third roller assembly is located on the center shaft between the lever body and the second spring lever.

8. The rocker arm assembly of claim 4 wherein the spring lever includes a spring rest pad that extends vertically with respect to the lever body for retaining an end of the spring member.

9. The rocker arm assembly of claim 8 wherein the spring lever is symmetrical along an axis.

10. The rocker arm assembly of claim 1 wherein the latch pin is located at an end of the lever body opposite the first pivot point.

11. The rocker arm assembly of claim 10 wherein the latch pin has a cylindrical outer surface and a flat end.

12. The rocker arm assembly of claim 1 wherein the coupling lever includes a first opening for receiving the second shaft.

13. The rocker arm assembly of claim 12 wherein the coupling lever includes a second opening for receiving the center shaft.

14. The rocker arm assembly of claim 12 wherein the first opening has an enlarged shape such that the coupling lever is moveable relative to the second shaft.

15. A two step rocker arm assembly comprising:

a lever body having a pair of arms that each include a spring retainer portion;

a first roller assembly mounted to the lever body;

a center shaft extending through the first roller assembly and moveable with respect to the lever body between a first position and a second position;

a coupling lever pivotally mounted to the lever body and having an opening for receiving the center shaft therethrough, the coupling lever rotatable about a first pivot point;

a latch pin mounted to the lever body and moveable between a retracted position and an extended position which inhibits pivoting of the coupling lever;

a second roller assembly mounted on the center shaft;

a pair of spring levers pivotally mounted to the lever body and connected to the center shaft, the spring levers having a spring rest pad, the spring levers rotatable about the first pivot point; and a spring member having a connecting portion that extends between a first end and a second end, wherein the connecting portion is retained by the spring retainer portions on the lever body, the first end is retained by the spring rest pad of one of the spring levers and the second end is retained by the spring rest pad of the other spring lever.

16. The rocker arm assembly of claim 15 wherein a side of the lever body is flat.

17. The rocker arm assembly of claim 15 wherein the spring retainer portion is "L"-shaped.

18. The rocker arm assembly of claim 15 wherein the spring member includes a first coiled portion between the connecting portion and the first end and a second coiled portion between the connecting portion and the second end.

19. A rocker arm assembly for use in a valve train comprising:

a lever body;

a center shaft extending through the lever body and moveable with respect to the lever body between a first position and a second position;

a coupling lever having an opening for receiving the center shaft and having an extending lever arm, the coupling lever pivotally mounted to the lever body at an end of the extending lever arm and rotatable about a first pivot point;

a spring lever pivotally mounted to the lever body and connected to the center shaft, the spring lever rotatable about the first pivot point; and a spring member mounted on the lever body that engages the spring lever to bias the spring lever and the center shaft into the first position.

* * * * *